US005833438A

United States Patent [19]

Sundberg

[11] Patent Number: 5,833,438

[45] Date of Patent: Nov. 10, 1998

[54] VARIABLE DISPLACEMENT VANE PUMP HAVING CAM SEAL WITH SEAL LAND

[75] Inventor: Jack G. Sundberg, Meriden, Conn.

[73] Assignee: Coltec Industries Inc, New York, N.Y.

[21] Appl. No.: 509,400

[22] Filed: Jul. 31, 1995

[51] Int. Cl.[6] ..... F04C 2/344; F04B 23/10

[52] U.S. Cl. ..... 417/204; 413/133

[58] Field of Search ..... 417/204, 220; 418/24–27, 30, 31, 82

[56] References Cited

U.S. PATENT DOCUMENTS

| | | | |
|---|---|---|---|
| 2,423,271 | 7/1947 | Talbot | 418/27 |
| 2,782,724 | 2/1957 | Humphreys | 418/133 |
| 3,107,628 | 10/1963 | Rynders et al. | 418/26 |
| 3,137,235 | 6/1964 | Brown | 417/220 |
| 4,551,079 | 11/1985 | Kain | 418/26 |

*Primary Examiner*—John J. Vrablik
*Attorney, Agent, or Firm*—Howard S. Reiter, E

[57] ABSTRACT

A variable displacement vane pump comprising a durable rotor member having journal ends at each side of a larger diameter central vane section comprising vane slots having well areas which slidably-engage a mating vane element. The present vane pump comprise novel cylindrical ring seal elements having a unitary body which seal the faces of the cam member, and which overlap the central vane section and vane slot extensions. The seal elements include first fuel inlet passages in the inlet arc segment thereof, and fuel discharge passages in the discharge arc thereof, both of said passages being open to the vane slot extensions and to the cam chamber for the continuous supply and pressure discharge of fuel.

2 Claims, 2 Drawing Sheets

VARIABLE DISPLACEMENT VANE PUMP HAVING CAM SEAL WITH SEAL LAND

BACKGROUND OF THE INVENTION

1. Field of the Invention

The present invention relates to single acting, variable displacement fluid pressure vane pumps and motors for aircraft use.

Over the years, the standard of the commercial aviation gas turbine industry for main engine fuel pumps has been a single element, pressure-loaded, involute gear stage charged with a centrifugal boost stage. Such gear pumps are simple and extremely durable, although heavy and inefficient. However, such gear pumps are fixed displacement pumps which deliver uniform amounts of fluid, such as fuel, under all operating conditions. Certain operating conditions require different volumes of liquid, and it is desirable and/or necessary to vary the liquid supply, by means such as bypass systems which can cause overheating of the fuel or hydraulic fluid and which require heat transfer cooling components that add to the cost and the weight of the system.

2. State of the Art:

Vane pumps and systems have been developed in order to overcome some of the deficiencies of gear pumps, and reference is made to the following U.S. Patents for their disclosures of several such pumps and systems: 4,247,263; 4,354,809; 4,529,361 and 4,711,619. Reference is also made to co-pending commonly-owned application U.S. Ser. No. 08/114,253, filed Aug. 30, 1993, U.S. Pat. No. 5,545,014, the disclosure of which is hereby incorporated herein.

Vane pumps comprise a rotor element machined with slots supporting radially-movable vane elements, rotatable within a cam member between opposed bearings, and having fluid inlet and outlet ports through which the fluid is fed to the low pressure inlet areas or vane buckets of the rotor surface for rotation, compression and discharge from the high pressure outlet areas or vane buckets of the rotor surface as pressurized fluid.

Vane pumps that are required to operate at high speeds and pressures preferably employ hydrostatically (pressure balanced) vanes for minimizing frictional wear. Such pumps may also include rounded vane tips to reduce vane-to-cam surface stresses. Examples of vane pumps having pressure-balanced vanes which are also adapted to provide undervane pumping, may be found in the aforementioned copending application and in U.S. Pat. Nos. 3,711,227 and 4,354,809. The latter patent discloses a vane pump incorporating undervane pumping wherein the vanes are hydraulically balanced in not only the inlet and discharge areas but also in the seal arcs whereby the resultant pressure forces on a vane cannot displace it from engagement with a seal arc.

Variable displacement vane pumps contain a swing cam element which is adjustable or pivotable, relative to the rotor element, in order to change the relative volumes of the inlet and outlet or discharge buckets and thereby vary the displacement capacity of the pump.

In conventional single acting vane pumps the rotor is splined upon and driven by a central drive shaft having small diameter journal ends/which are not strong enough to withstand the opposed inlet and outlet hydraulic pressure forces generated during normal operation. This problem is overcome by forming such pumps as double-acting pumps having opposed inlet arcs and opposed outlet or discharge arcs which balance the forces exerted upon the journal ends, as disclosed by the prior art such as U.S. Pat. Nos. 4,354,809 and 4,529,361, for example.

Among the disadvantages of the latter known vane pumps is the necessity of two inlet arcs and two discharge arcs as compared to single acting pumps which have a single inlet arc and a single outlet arc. The shorter inlet arcs of dual-acting pumps requires that the vanes be pressure-loaded in the area of the inlet arc in order to cause the vane tip to track or maintain continuous contact with the cam surface. This results in higher vane-to-cam stresses and eliminates use of undervane pumping. The dual pump arcs also introduce leakage areas, which require the use of multi-part pressure-balanced cam seals to seal the ends of the rotor and the cam faces for the purpose of containing the pressurized fluid and avoiding the creation of a high pressure gradient along the entire length of the rotor element and its journal ends. The present invention is concerned with improvements in such cam seals to produce vane pumps having improved efficiency and performance while reducing pressure loads exerted against the rotor in the pressure discharge direction.

SUMMARY OF THE INVENTION

The present invention relates to novel single acting, variable displacement vane pumps, which have the durability, ruggedness and simplicity of conventional gear pumps, and the versatility and variable metering properties of vane pumps, while incorporating novel pressure balanced cam seals of reduced complexity, more effective cam seal leakage resistance and reduced risk of failure, to more effectively confine the high pressure within the cam member and prevent axial pressure leakage along the length of the rotor member.

The novel pumps of the present invention comprise a durable, rotor member which is machined from barstock, in manner and appearance similar to the main pumping gear of a gear pump, so as to have large diameter journal ends at each side of a larger diameter central vane section comprising a plurality of axially-elongated radial vane slots, well areas of each vane slot slidably-engaging a mating vane element. An adjustable narrow cam member having a continuous circular inner cam surface surrounds and encloses the central vane section, and the cam surface is engaged by the outer surfaces or tips of the vane elements during operation of the pump. The journal ends of the rotor member are rotatably-supported within opposed durable bearings, which are fixed to the housing and have faces which confine the present cylindrical cam seals between themselves and the opposed faces of the cam member. During rotation of the journals of the vaned rotor member within the bearings and of the raised central vane section of the rotor member within the cam member, fluid such as liquid fuel is admitted at low pressure to the inlet arc segment of the cam chamber, through inlet passages through each of the cam seals, and into expanding inlet bucket chambers between the vanes, and also through the vane slot extensions to under-vane chambers. Continued rotation of the rotor member through a sealing arc segment into a discharge arc segment reduces the volume of the bucket areas and changes the pressure acting upon the leading face of each vane from low inlet pressure to increasing discharge pressure as the volume of each bucket chamber is gradually compressed at the discharge side or arc of the eccentric cam chamber. The pressurized fuel escapes through discharge passages in each seal and bearing, and is channelled to its desired destination.

The undervane and overvane pressures acting upon the vanes are balanced so that the vanes are lightly loaded or "floated" throughout the operation of the present pumps. This reduces wear on the vanes and, most importantly, provides elasto-hydrodynamic lubrication of the interface of the vane tips and the continuous cam surface. Such balancing is made possible by venting the undervane slot areas to an intermediate fluid pressure in the seal arc segments of the cam seals and bearings whereby, as each vane is rotated from the low pressure inlet segment to the high pressure discharge segment, and vice versa, the pressure in the undervane slot areas is automatically regulated to an intermediate pressure at the seal arc segments, whereby the undervane and overvane pressures are balanced which prevents the vane elements from being either urged against the cam surface with excessive force or from losing contact with the cam surface.

The novel vane pumps of the present invention also provide substantial undervane pumping of the fluid from the undervane slot areas by piston action as the vanes are depressed into the slots at the discharge side of the cam chamber. Such undervane pumping can contribute up to 40% or more of the total fluid displacement.

The essential novelty of the vane pumps of the present invention resides in the novel rotor and the cylindrical cam seal elements, each of which has an outer annular contact ring portion which continuously seals a face side of the cam member, in the high pressure discharge arc segment thereof, and a recessed inner annular seal land portion which overlaps and is closely-spaced from the raised central vane portion of the rotor, to permit free rotation thereof, but which sealingly-engages the housing and the bearing member against which it is mounted, to seal axial leakage to the journals.

The present pressure-balanced cam seal elements are integral annular bushing elements which are sealingly engaged within the pump housing between a bearing member and a face of the cam element, and which are provided with fluid inlet passages in the inlet arc area of the cam chamber and with fluid discharge or outlet passages in the discharge arc area of the cam chamber. The cam seal elements are pressure-loaded against the cam face and overlap the vane slots and provide a 360° seal land with the rotor to seal the fluid discharge passage in the pumping arc from axial leakage along the rotor journals.

DETAILED DESCRIPTION

Figure 1:
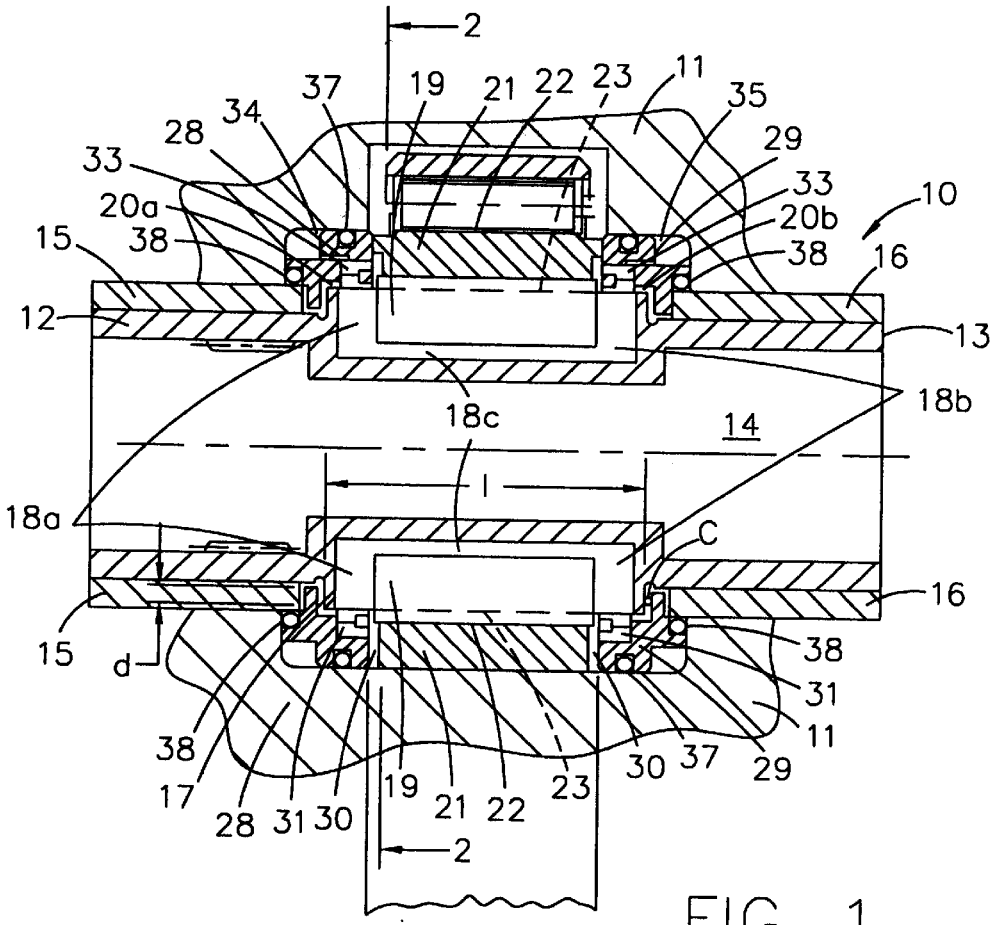
FIG. 1 is a vertical cross-sectional view of a fuel pump assembly according to one embodiment of the present invention.

FIG. 1 illustrates a fuel pump assembly 10 sealingly engaged within a housing 11 for free rotation of the journal ends 12 and 13 of the rotor member 14 within bearings 15 and 16 which are interference fit within the housing 11. The rotor member 14 comprises a cylindrical central vane-supporting section 17 of increased diameter, relative to the journal ends 12 and 13, and having a length "1", as shown more clearly in FIG. 3. Rotor section 17 comprises a plurality of radially-extending vane slots 18, generally ten in number, each of which supports a vane element 19 for radial movement therewithin and each of which is longer than the vane element 19 to provide slot extensions 18*a* and 18*b* adjacent each end of the vane element, which extensions communicate with undervane slot areas 18*c*. The vane slots 18 are shorter in length than the length "1" of the rotor section 17 to leave continuous 360° marginal bearing areas 20*a* and 20*b* around the opposed edges of the rotor section 17.

The pump assembly 10 also comprises an annular cam member 21 having a smooth continuous inner cam surface 22 which is spaced from the surface of the rotor section 17 to provide an eccentric annular cam chamber 23 which is variable by adjusting the concentricity of the cam member 21 relative to the rotor member 14 to vary the displacement of the pump.

The cam chamber 23 is divided into cam bucket areas which are the areas between the faces of adjacent vane elements 19 carried by the rotor section 17. As is conventional with variable displacement vane pumps, the volume or capacity of the vane bucket areas increases in the low pressure fluid inlet arc 24 of the pump, shown in FIG. 2, to fill with the liquid, such as fuel, and decreases through the high pressure fluid discharge arc 26 of the pump to displace the fluid. Seal arcs 25 and 27 are provided between the low and high pressure areas 24 and 27 to isolate and seal them from each other and provide for normal cyclical pumping operation.

The final essential elements of the present fuel pump assemblies 10 are the unitary cam seal elements 28 and 29 which are annular ring seal members which sealingly engage the cam faces and the housing 11 within which the seal elements are mounted, and which contain isolated fuel inlet and fuel outlet or discharge passages which communicate with the vane slots in the fuel inlet arc and fuel discharge arc 26 areas of the cam chamber to admit fuel to the low pressure inlet buckets of the cam chamber and to permit the escape of the high pressure fuel from the discharge buckets of the cam chamber.

The single piece cam seal elements 28 and 29 of the present invention are less complex and more durable than prior known multi-component cam seal elements used on variable displacement vane pumps of different types to serve the same purposes, i.e., to seal the cam faces in the seal arc areas 25 and 27 of the cam chamber and to admit fuel or other liquid in the low pressure inlet arc 24 and to channel the fuel or other liquid from the high pressure discharge arc 26 to an outlet conduit while sealing the pump against axial leakage along the journal ends 12 and 13 of the rotor member 14.

Figure 2:
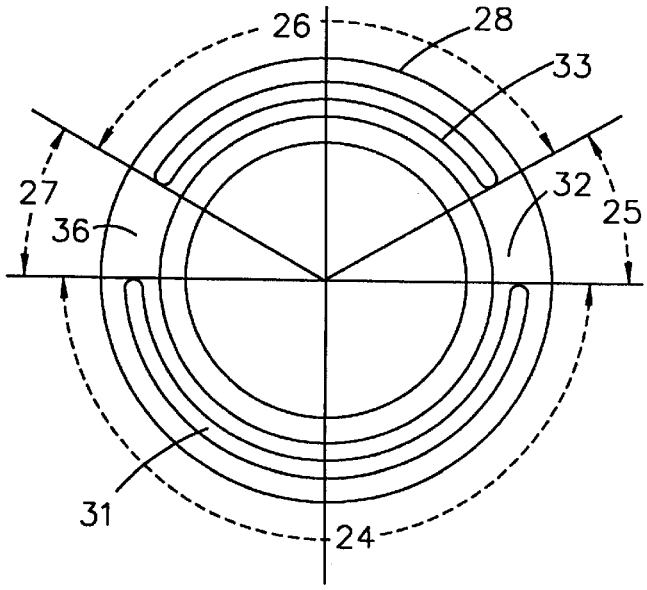
FIG. 2 is a view of the cam seal of FIG. 1 taken along the line 2—2.
Figure 3:
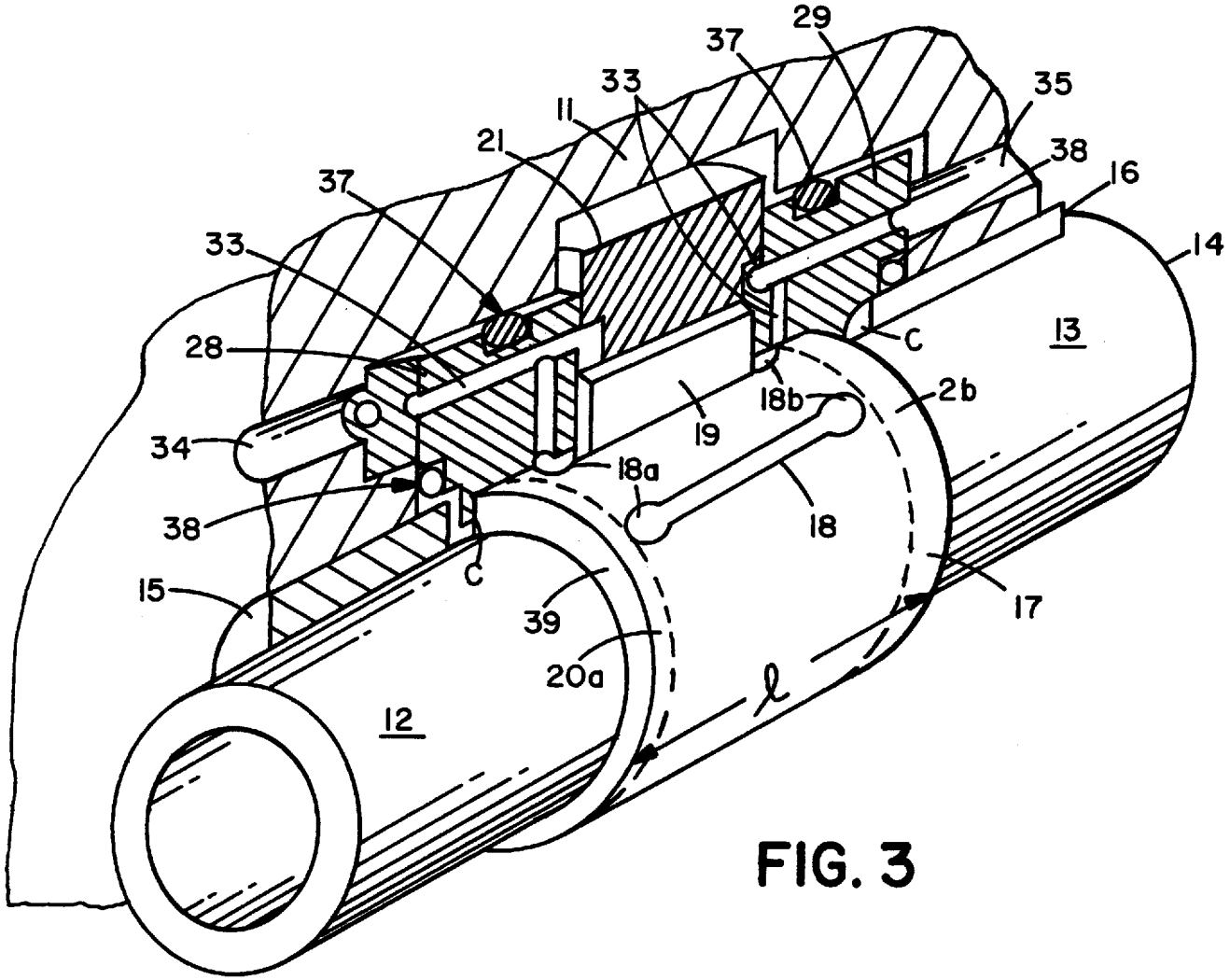
FIG. 3 is a perspective partial cross-section of the fuel pump assembly of FIG. 1.

As shown most clearly by the sectioned view of FIG. 3 and the face view of FIG. 2, the cam seal elements 28 and 29 are identical to each other and are pressure loaded against the opposed cam faces to provide a 360° outer peripheral seal except in the area of the fuel inlet grooves or passages 30 in the cam surface in the fuel inlet arc 24 of the pump, shown in FIG. 1, which communicate through fuel inlet passages (not shown) with a source of liquid, such as a fuel, at intermediate pressure and admit fuel into the arcuate opening to cam seal inlet passage 31 of the seal elements 28 and 29 to be conveyed to the vane slot extensions 18*a* and 18*b* and to the undervane slot areas 18*c* of each vane slot 18 as the rotor 14 rotates through the inlet arc 24. This fills each of the vane buckets before it is rotated into the inlet seal arc 25, where it becomes sealed by the face 32 of the seal element 28 or 29, while each vane bucket contracts to pressurize the fuel therewithin. Rotation of the rotor member into the discharge arc 26 opens the vane buckets to the arcuate opening from cam seal outlet passage 33, through the vane slot extensions 18*a* and 18*b*, to channel the pressurized fuel from the vane buckets and from the undervane slot areas 18*c* through the cam seal outlet passages 33 and through housing discharge conduits 34 or 35, shown in FIG. 3, to the desired destination, such as a fuel-powered engine.

As the rotor member rotates from the discharge arc 26 through the second seal arc 27, the vane buckets become sealed by the face 36 of the seal element 28 or 29 before entry into the low pressure inlet seal arc 24 of the cam chamber and communication with the fuel inlet passage 31 of the cam seal elements 28 and 29. A continuous supply of liquid fuel is fed into the vane buckets through the fuel inlet grooves or passages 30 present in the cam faces in the fuel inlet arc 24, and through the cam seal inlet passages 31 in the fuel inlet arc 24, to fill the vane slot extensions 18*a* and 18*b*, the undervane areas 18*c*, and the expanded vane buckets before they are sealed by the inlet seal element faces 32 to repeat the pumping cycle.

As illustrated most clearly by FIG. 3, each seal element 28 and 29 is sealed to the housing 11, adjacent the area of its pressure engagement with the cam face, by means of an outer peripheral gasket or o-ring 37, to prevent axial fuel leakage in both the inlet arc 24 and the discharge arc 26. Also, each seal element 28 and 29 is sealed to the housing 11, and to a fixed rotor bearing 15 or 16, by means of an inner peripheral gasket or o-ring 38, to prevent axial fuel leakage along the journals 12 and 13 of the rotor member 14.

As shown most clearly by FIG. 3, the seal elements 28 and 29 have an inner circumferential surface comprising a flange portion which extends between the rotor bearings 15 or 16 and the opposed smooth flat radial faces 39 of the central vane-supporting section 17, and a wall extension which overlaps the marginal bearing areas 20*a* and 20*b*, leaving a small clearance "c" therebetween, such as from 0.0002 "to about 0.0005" loose, over distance "d", as shown in FIG. 1. This clearance provides the area for a seal land to further seal leakage to the rotor journals 12 and 13 of the rotor member 14, adjacent the 360° bearing areas 20*a* and 20*b* which function as a seal between the pumping arc 26 and the rotor journals 12 and 13. The end result is a simplified VDVP having excellent efficiency and minimized fuel leakage which is confined internally to provide lubrication during pump operation.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A durable, vane pump comprising:

(a) rotor member having journal ends and a cylindrical central vane section having a radius greater than said journal ends and comprising a plurality of radial vane slots uniformly spaced around the central circumference thereof, said vane slots being elongate in the axial direction and being shorter than said rotor vane section to provide marginal bearing areas around the opposed edges of the rotor vane section, each vane slot having a central vane-supporting portion with axial vane slot extensions at each end thereof;

(b) a plurality of vane elements, each slidably-engaged within the central vane-supporting portion of a said vane slot for radial movement therewithin, leaving said vane slot extensions at each end thereof;

(c) a unitary cam member having opposed faces and a bore therethrough forming a cam chamber having a continuous interior cam surface, the central vane-supporting portion of the cylindrical vane section of said rotor member being supported axially and non-concentrically within said cam chamber so that the outer tip surfaces of all of the vane elements make contact with said continuous interior cam surface during rotation of said rotor member between a low pressure fuel inlet arc segment, a high pressure fuel outlet arc segment and intermediate seal arc segments of said cam chamber, and said vane slot extensions and marginal bearing areas project axially beyond said cam chamber;

(d) an opposed pair of bearings rotatably supporting the journal ends of said rotor member; and (e) an opposed pair of cylindrical cam seal elements, one each between a said bearing and a face of said cam member, each said seal element having an annular outer circumference adapted to sealingly engage a support housing, a radial face surface which sealingly engages a said face of the cam member, and an inner circumferential surface comprising an annular flange portion which extends between one of said bearings and a side wall of said central vane section and the surface of a journal end of the rotor member, said inner circumferential surface extending from said flange portion to overlap the marginal bearing areas and the vane slot extensions of the central vane section of the rotor member; each said seal element further including liquid-conveying passages which open through the portion of the inner circumferential surface which overlaps the vane slot extensions and communicate with the cam chamber, the first said passage being located in the inlet arc segment of each seal element and being open to liquid-inlet grooves in the surface of the cam faces to admit a liquid from a liquid source through said liquid inlet grooves to said vane slots at art intermediate pressure in the inlet arc segment of each seal element, and the second said passage being located in the discharge arc segment of each seal element and being open to a liquid discharge conduit to discharge said liquid under increased pressure in the discharge arc segment of each seal element to a desired destination, to permit the continuous supply and pressure discharge of a liquid through said pump while minimizing leakage thereof.

2. A pump according to claim 1 in which each said cam seal element includes an outer peripheral gasket adapted to sealingly engage a support housing, adjacent the area at which the radial face of the seal element sealingly engages the cam face, and an inner peripheral gasket which is adapted to sealingly engage a portion of a support housing adjacent a bearing, to seal the pump against axial liquid leakage.

* * * * *